United States Patent [19]

Cazaly

[11] Patent Number: 4,751,804

[45] Date of Patent: Jun. 21, 1988

[54] UTILITY POLE

[76] Inventor: Laurence G. Cazaly, 19 Bryson Drive, Thornhill, Ontario, Canada, L4C 6E2

[21] Appl. No.: 941,969

[22] Filed: Dec. 15, 1986

Related U.S. Application Data

[63] Continuation-in-part of Ser. No. 793,415, Oct. 31, 1985, abandoned.

[51] Int. Cl.[4] ..... E04C 3/34

[52] U.S. Cl. ..... 52/722; 52/309.17; 52/245

[58] Field of Search ..... 52/245, 248, 309.17, 52/722, 723, 725

[56] References Cited

U.S. PATENT DOCUMENTS 4,314,957 2/1982 Ozawa ..... 264/102

4,404,786 9/1983 Rotondo et al. ..... 52/659

FOREIGN PATENT DOCUMENTS 179366 9/1935 Switzerland .

*Primary Examiner*—David A. Scherbel
*Assistant Examiner*—Creighton Smith
*Attorney, Agent, or Firm*—Moss, Hammond

[57] ABSTRACT

A tubular elongate pole comprises a pole wall having a plurality of small diameter wires embedded in a polymer-containing matrix bonded to the wires to form an encapsulating shell of relatively low weight and which is substantially impermeable to aqueous corrosive liquids; the matrix has a density greater than that of concrete conventionally employed in reinforced concrete poles and yet the pole is considerably lighter in weight and indeed of a weight comparable to that of a wood pole.

11 Claims, 5 Drawing Sheets

UTILITY POLE

CROSS-REFERENCE TO RELATED APPLICATIONS

This application is a continuation-in-part of U.S. patent application, Ser. No. 793,415, filed Oct. 31, 1985, now abandoned.

BACKGROUND OF THE INVENTION (i) Field of the Invention

This invention relates to poles and their production, more especially it is concerned with utility or distribution poles which may be used to support overhead lines in power transmission and in external lighting of different kinds, for example, street and highway lighting.

(ii) Brief Description of the Prior Art

Most of the utility poles in use are wood poles. Wood poles are light, easy to erect, have acceptable durability and are relatively inexpensive.

It is expected that in future, the supply of wood poles will not meet the demand for poles. In addition, while wood poles are satisfactory for use in rural areas, where they blend with the rural landscape and environment, and there is an abundance of space for guying, they are generally considered unsatisfactory in urban areas where space is limited and where they do not blend architecturally with the urban landscape and environment.

Concrete poles have been employed in urban areas, which poles have an aesthetically pleasing appearance in the urban landscape and blend in with their surroundings. Concrete poles are reinforced, typically with steel bars or rods, to provide adequate strength and deflection characteristics.

The reinforcing steel bars or rods in concrete poles are subject to the corrosive action of water containing dissolved components found in the environment such as salts and acidic gases, which water penetrates through the pores of the concrete.

In view of this it is necessary to provide a concrete pole with a thick concrete wall, typically more than 2 in. thick, in order to protect the reinforcing rods against such corrosion, and provide a pole with a satisfactory life. This need for a thick concrete wall results in a pole which is about twice the weight of a wood pole of comparable length. The greater weight of the conventional reinforced concrete poles increases the cost of installation relative to wood poles and, in particular, requires the use of more expensive equipment.

Reinforced concrete has been employed in products for outdoor use for over 100 years. Practical rules have evolved for such reinforced concrete in order that products have an acceptable working life. These rules, including those which govern poles, are set forth in A.C.I. (American Concrete Institute) 318-83 Building Code Requirements for Reinforced Concrete which specifies:

(i) The reinforcement, except for spirals and tendons, shall be deformed bars (Clause 3.5.1.).

(ii) Designs may not use a yield strength exceeding 80,000 psi (Clause 9.4.).

(iii) Concrete cover over the reinforcing bars shall not be less than 1.25 inches (Clause 7.7.2(a).).

These requirements arise from the fact that, on the one hand, concrete cracks at low levels of tensile stress and, for strength, the tensile zones of concrete structural members must be reinforced with steel while, on the other hand, exposed steel corrodes easily and, for durability, it must be protected by the concrete. Since the protection provided by the concrete depends, in part, on its thickness and in part on the size of cracks in it, it has been found necessary to employ a minimum cover of concrete, depending on the exposure, and to limit crack sizes by limiting the shape and strength of reinforcement.

Concrete poles have the same durability needs as other concrete products. Indeed, those poles placed adjacent to salted roadways and along salt-water shore lines experience an even more aggressive environment than the average outdoor structure and should preferably be subject to greater durability measures than the minimum.

While early concrete poles were wet-cast, most poles in North America are now made by the spin-casting process, which allows the production of a hollow shell of concrete of circular or polygonal shape. The theoretical minimum wall thickness of such a shell is governed by the requirement that the cover on each side must be at least $\frac{3}{4}$ inch while the smallest deformed reinforcement bar has a diameter of $\frac{3}{8}$ inch, for a total thickness of $1\frac{7}{8}$ inch. Since concrete has approximately five times the density of wood, and since the external dimensions of concrete and wood poles are similar, it can readily be shown that durable hollow concrete poles must, theoretically, weigh more than twice as much as a solid wood pole. In practice, since reinforcing bars are more commonly required to be $\frac{1}{2}$ inch or $\frac{5}{8}$ inch in diameter, and since many poles need to incorporate reinforcing spirals, wound over the axial reinforcement; and since some allowance for construction tolerance must be maintained, most concrete poles have shell thicknesses greater than 2 inches and have a weight closer to three times the weight of the corresponding wood pole. For example, a typical 45 foot long wood distribution pole would weigh about 900 lbs. (with a modest variation for class and species) while the corresponding concrete pole would weigh about 2,700 lbs.

Since most pole users have moving and erection equipment proportioned to the more commonly used wood pole, it is clear that the substantial weight difference is an economic burden and an operational nuisance, and a weight closer to that of wood is highly desirable.

Furthermore, since concrete poles are more commonly used in urban areas, and since pole replacement on busy streets is both costly and a traffic hazard, it is desirable that urban poles should have a longer life than either the wood poles or the concrete poles currently in use, and the conventional way of increasing durability by increasing the wall thickness and thus the weight is clearly objectionable.

Swiss Pat. No. 179,366 issued Sept. 15, 1935, Gustav E. Vogt, teaches a hollow concrete pole reinforced with reinforcing rods and having an irregular polygon as its cross section, in which alternate sides contain reinforcement and are of conventional thickness while the intermediate sides contain no reinforcement and can therefore be made thinner.

According to Vogt, the thinning of some sides, made possible by omitting the reinforcement in them, leads to a desirable saving in weight. However, a consequent disadvantage of Vogt is that the pole may not be tapered, which increases the weight as compared with a tapered pole and, because only half the perimeter is available for reinforcement, the number of bars that can be contained must be either less than can be contained in a conventional pole or else the total perimeter must be increased by increasing the diameter of the pole.

Attempts have also been made to protect the steel reinforcing rods without the need for a thick concrete wall, for example, by galvanizing to provide a sacrificial coating of zinc on the steel surface. However, the resulting poles do not have a satisfactory life.

It is an object of this invention to overcome the disadvantages of conventional reinforced concrete poles, while at the same time providing a pole having the aesthetic appearance associated with the reinforced concrete pole.

It is a further object of this invention to provide a pole which is light in weight, as compared with a reinforced concrete pole, and yet is durable and has a long life.

It is still another object of this invention to provide a thin walled, tapered, tubular pole having good deflection characteristics.

It is yet another object of this invention to provide a pole which is concrete-like in appearance and performance and yet has a weight substantially less than that of a conventional concrete pole and closer to that of a wood pole.

It is still a further object of this invention to provide a pole of increased durability without sacrificing the saving in weight.

It is yet a further object of this invention to achieve these effects by combining methods and materials which substantially reduce the thickness of pole wall which can be used.

It is yet another object of this invention to provide a method of manufacturing a pole.

SUMMARY OF THE INVENTION

It has now, surprisingly, been found that a hollow pole can be produced which has the appearance of a reinforced concrete pole and yet is much lighter in weight than a reinforced concrete pole, and, in particular has a weight closer to that of a wood pole, employing a matrix which is of greater density than concrete having small diameter wires, rather than the conventional larger diameter bars or rods, embedded in the matrix.

In particular, the matrix is a polymer-containing matrix formed of a mass comprising particulate mineral aggregate with free spaces within the mass filled with the polymer such that the matrix is substantially impervious to aqueous corrosive liquid.

The matrix is, in particular, a polymer concrete or polymer impregnated concrete substantially free of water and not having the ability to protect steel reinforcement by neutralization of aqueous corrosive liquid which permeates the concrete. The polymer of the matrix is suitably in a rubbery state at ambient temperature so as to provide high ductility, rather than in a glassy state.

Thus the present invention employs firstly a matrix of greater density and not having the capability of protecting steel reinforcement embedded therein by neutralization of corrosive liquids, and to produce a pole of greater durability and lighter weight; and secondly employs small diameter wires rather than larger diameter bars or rods while still providing the requisite characteristics.

The pole is in particular of a regular external profile and tapered from the butt to the tip.

In particular the small diameter wires define an elongate hollow cone of wires embedded in the polymer-containing matrix bonded to the wires, thereby forming a solid cone wall of relatively low weight per unit area and which due to the matrix is substantially impermeable to aqueous corrosive liquids.

The solid tubular cone wall defines a pole having a weight comparable with a wood pole of similar dimensions and which can thus be readily transported and installed using equipment employed for wood poles.

It will be understood that the term "cone" as employed herein contemplates a truncated cone.

The hollow cone of wires forms the primary structure of the pole, while the polymer-containing matrix encapsulates and protects the wires against corrosion, provides an elongate tubular body of good appearance and holds the wires in a fixed structurally effective relationship.

According to one aspect of the present invention, a pole is provided for public utility lines, lighting apparatus and the like, comprising an elongate, tubular pole wall comprising a plurality of elongate wires having diameters of about 0.04 to about 0.47 in., the wires being disposed in a circumferential layer about 0.04 to about 0.47 in. in thickness and arranged to give equal bending strength in any direction perpendicular to the longitudinal axis of the pole. The wires have a yield strength above 80,000 psi and a modulus of elasticity in excess of $14.5\times10^6$ psi. The polymer containing matrix is bonded to the wires and forms a shell encapsulating the wires. The pole wall has a weight less than 20.5 $lb/ft^2$ of the wall.

According to another aspect of the invention, a method is provided for producing a pole as described above, which method comprises the steps of forming a hollow cone of the wires, binding the wires with spiral reinforcement to hold same in place, molding a moldable polymer concrete about the cone to form an encapsulating shell with the hollow cone embedded therein, and solidifying the cone wall.

According to yet another aspect of the invention, a method is provided for producing a pole as described above, which method comprises the steps of forming a hollow cone of wires, binding the wires with spiral reinforcement to hold same in place, casting a Portland Cement concrete about the cone to form a shaped encapsulating shell, solidifying the shaped encapsulating shell, drying the shaped shell to remove water from pores and voids, impregnating the shell with polymer-forming monomers to fill the pores and voids and polymerizing or curing the monomers to a polymer.

BRIEF DESCRIPTION OF THE DRAWINGS

The invention is illustrated in particular and preferred embodiments by reference to accompanying drawings, in which.

DETAILED DESCRIPTION OF PREFERRED EMBODIMENTS

Figure 1:
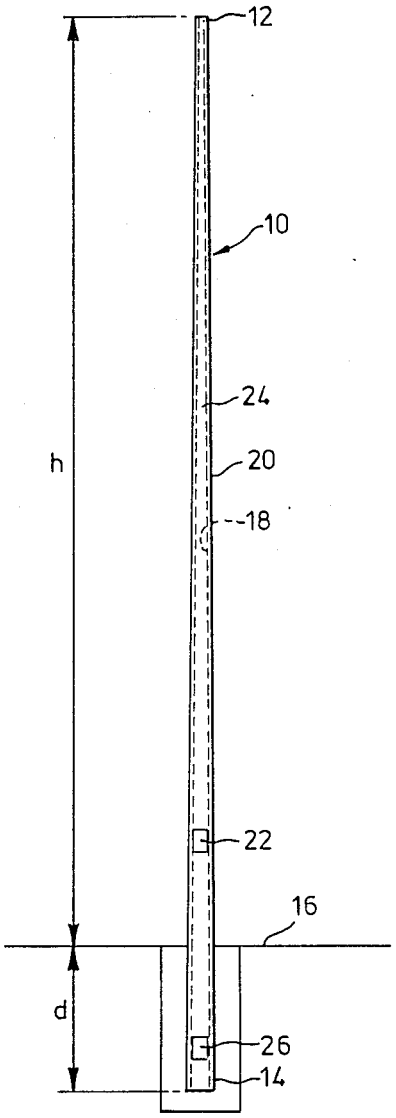
FIG. 1 illustrates schematically a pole of the invention.

With reference to FIG. 1, a tubular pole 10 has a tip 12 and a base 14.

Pole 10 has an inner tubular surface 18 and an outer tubular surface 20. A tubular passage 24 provides a housing for the electrical wiring. A port 26 in base 14 provides an entry for underground wiring. Access port 22 provides access to the wiring for maintenance and repair. The pole 10 is installed in ground 16 with a height "h" above ground 16 typically between 30 and 65 ft. and a depth "b" below ground 16 of about 6 ft. A common total length of pole 10 is about 50 ft.

Figure 2:
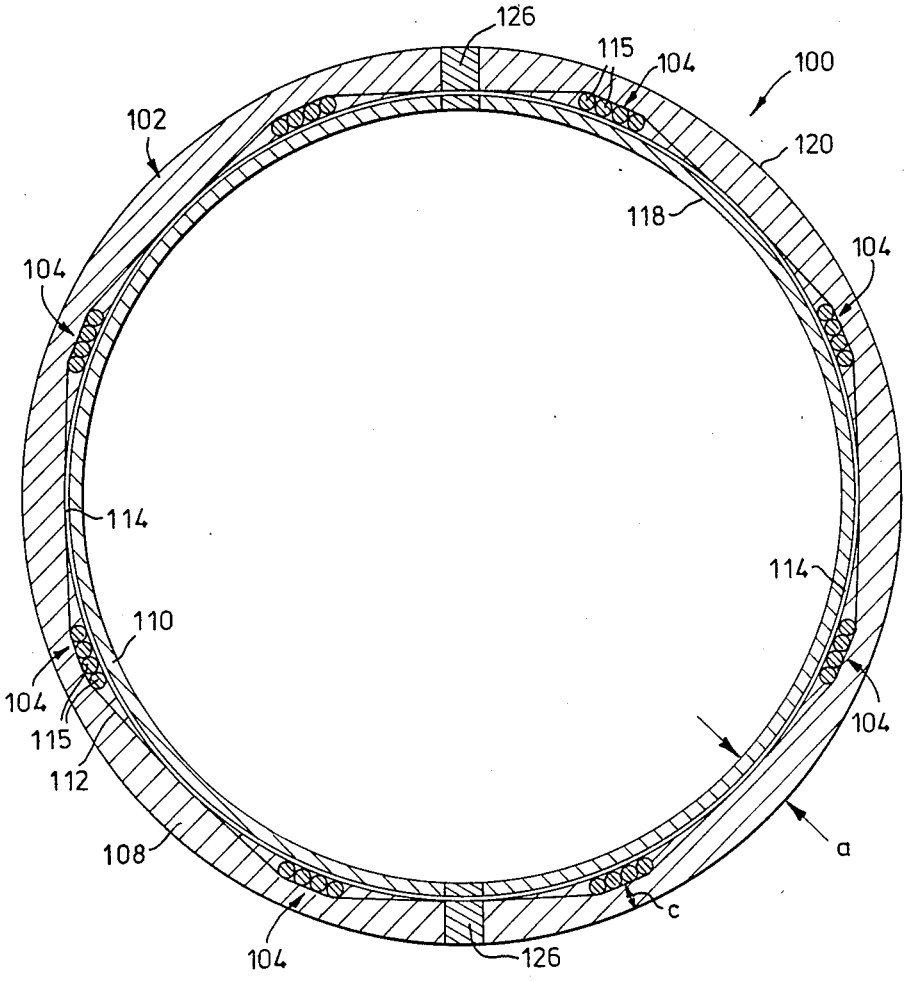
FIG. 2 shows a cross-section of a pole of the invention in one embodiment.

With further reference to FIG. 2, a tubular pole 100 comprises a cone wall 102 having embedded therein a plurality of circumferentially spaced apart, symmetrically arranged wire groups or clusters 104 extending axially of pole 100 and forming a hollow cone.

Cone wall 102 includes an outer solid shell 108 of polymer-containing matrix and an inner shell 110 of the matrix. A structural steel or stainless steel spiral 114 is located inside the inwardly facing surfaces of bundles 104 primarily to hold the bundles in place during construction of pole 100. A spiral 112 of an inert plastic such as "Kevlar" fibre is wound around the outwardly facing surfaces of bundles 104. Kevlar is a trademark of E. I. duPont de Nemours and Co.

The groups 104 each comprise four identical wires 115 in side-by-side relationship, although different numbers and sizes of wires could be used as discussed further below.

The pole 100 has a tubular inner surface 118 and a tubular outer surface 120.

In a particular embodiment the cone wall 102 has a thickness "a" of $\frac{7}{8}$ in. (22 mm) and the wires 115 have diameters of 0.275 in. (7 mm). The inner shell 110 has a thickness of about 0.2 in. (5 mm), thus the distance "c" between groups 104 and the outer surface 120 is about 0.4 in. (about 10 mm). The groups 104 are thus closer to inner surface 118 than outer surface 120.

In pole 100, the zones in which the groups 104 forming the hollow cone of wires are located, are not readily apparent from a visual inspection. Therefore, plugs 126 are used in the cone wall at predetermined locations to provide attachment points for hardware, etc. Alternatively, a special instrument can be used to detect the location of the groups 104 so that holes for attachments can be drilled between groups 104 and hitting or exposure of the wires can be avoided.

Figure 3:
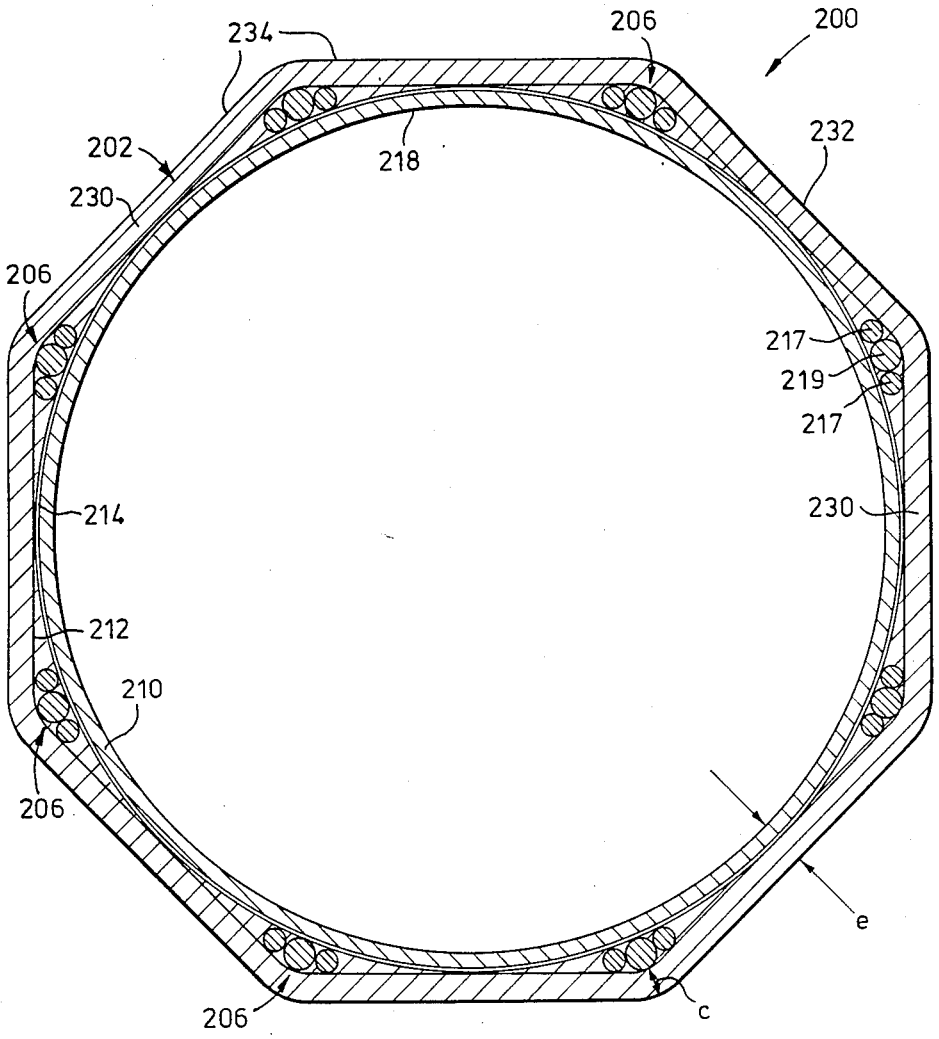
FIG. 3 shows a cross-section of a pole of the invention in another embodiment.

With further reference to FIG. 3, there is shown a pole 200. In so far as the pole 200 has parts corresponding to those of the pole 100 of FIG. 2, the same reference numerals have been employed, but increased by 100.

The pole 200 has an outer shell 230 which defines an outer surface 232 of eight flat sides 234. In this way the amount of polymer-containing matrix in the pole 200 is reduced where it is not needed to cover wires, thereby decreasing both the cost and the weight, and the minimum thickness "e" of cone wall 202 is reduced to about 0.63 in. (about 16 mm).

Pole 200 has embedded therein a plurality of spaced apart, symmetrically arranged wire clusters 206, each comprising two wires 217 of the same diameter and a larger diameter wire 219 therebetween. This provides for a uniform thickness of matrix or cover over wire clusters 206 while allowing the use of larger diameter wires than are used in pole 100 of FIG. 2.

Pole 200 has the advantage that the locations of the bundles 206 can be readily determined visually and the locations for drilling holes for attachments can be readily located centrally of sides 234 without the danger of hitting or exposing the wires of bundles 206.

Figure 4:
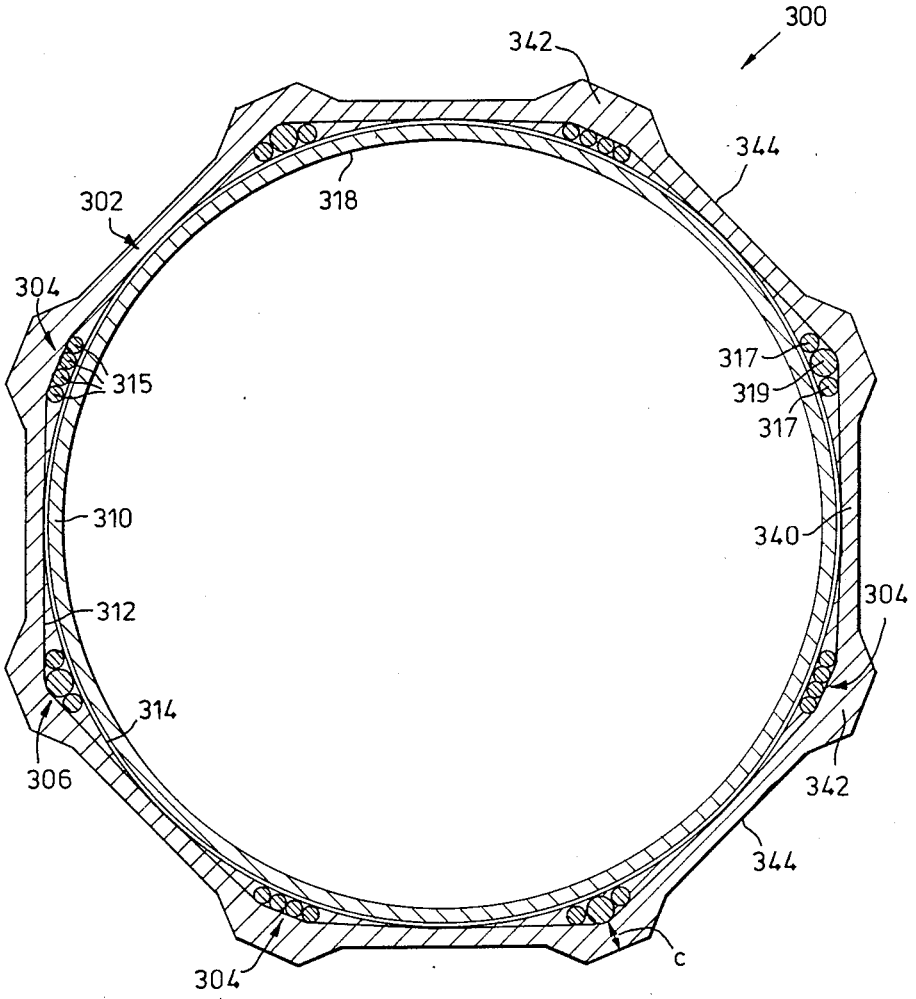
FIG. 4 shows a cross-section of a pole of the invention in yet another embodiment.

With further reference to FIG. 4 there is shown a pole 300. In so far as the pole 300 has parts corresponding to those of the pole 100 of FIG. 2, the same reference numerals have been employed but increased by 200.

The pole 300 has an outer shell 340 forming a plurality of protuberances 342 spaced apart by flat sides 344. The protuberances 342 are located radially outwardly of the wire clusters 304 and 306 and thus the thickness of outer shell 340 between the clusters 304 and 306 is significantly reduced thereby reducing the cost and weight of pole 300.

It will be apparent that both types of wire clusters 304 and 306 are used in pole 300. These are alternatives, and in fact, either type of wire cluster can be used in the poles 100 and 200 of FIGS. 2 and 3 as desired, provided sufficient thickness of matrix or cover is provided for the wires.

As in the case of the pole 200 of FIG. 3, the location of clusters 304 and 306 is readily apparent.

With further reference to FIGS. 5 to 8 and 9 there is illustrated, for comparison purposes, a pole of the invention (FIG. 9) with other poles.

Figures 5, 6, 7, 8, 9:
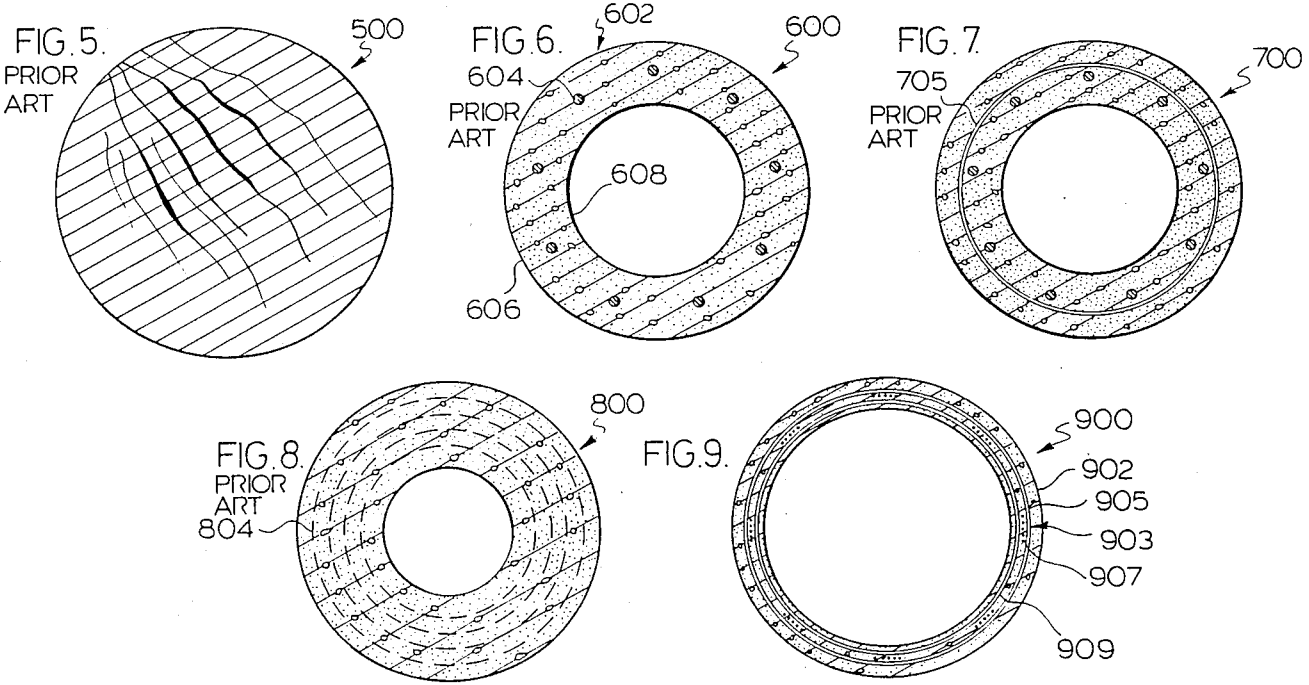
FIG. 5. PRIOR ART
FIG. 6. PRIOR ART
FIG. 7. PRIOR ART
FIG. 8. PRIOR ART
FIGS. 5 to 8 show in cross-section comparison poles including conventional wood and reinforced concrete poles.
FIG. 9 shows in cross-section a pole of the invention on the same scale as the poles of FIGS. 5 to 8.

With reference to FIG. 5 there is illustrated a typical wood distribution pole 500 which typically would be 45 ft. (13.7 m.) long Class 2, western red cedar pole. Such a pole 500 would be solid, with a tip diameter of about 7 in. (178 mm), a butt diameter of about 18 in. (457 mm) and a mean diameter of 10.8 in. (274 mm). The mean area would be about 92 in$^2$ (594 cm$^2$), the density about 30 lbs/ft$^3$ (480 kg/m$^3$) and the weight 900 lb. (410 kg.).

With reference to FIG. 6 there is illustrated an equivalent conventional concrete pole 600 having a tubular wall 602 and a plurality of axial reinforcing bars or rods 604. Wall 602 has an outer surface 606 and an inner surface 608. Pole 600 would have a tip diameter of about 5.7 in. (145 mm), a butt diameter of about 13.8 in. (350 mm) and a mean diameter of about 9.75 in. (248 mm). Wall 602 would include a minimum concrete cover of $\frac{3}{4}$ in. measured from bars 604 to outer and inner surfaces 606 and 608, respectively, and bars 604 would each have a diameter of $\frac{5}{8}$ in. (16 mm); the minimum possible thickness of wall 602 would be 2.125 in. (54 mm) for an internal diameter of 5.75 in. (140 mm). The mean area would be 50.9 in$^2$ (328 cm$^2$), the density about 160 lb/ft$^3$ (2560 kg/m$^3$) and the weight 2600 lb. (1180 kg.) which is almost three times that of the comparable wood pole of FIG. 5.

With reference to FIG. 7 there is shown a pole 700 comparable to that of FIG. 6 but also including steel spirals 705. In order to provide the minimum cover over the spirals 705, the minimum wall thickness becomes 2.375 in. (60 mm) and the pole weight would increase to at least 2800 lb. (1270 kg), which is more than three times that of pole 500 of FIG. 5.

With reference to FIG. 8 there is postulated a steel wire reinforced pole 800 of outer dimensions comparable to those of FIGS. 5 to 7, using 0.040 in. (1 mm) diameter wires 804, the number of wires 804 required for equivalent strength would be about 1500, with another 500 wires overlapping them at a given cross section. Since each wire needs to be surrounded by concrete, this number of wires requires about four circumferential rings to accommodate them with three layers of concrete between them as well as an outer layer and an inner layer, for a minimum thickness of wall of about 2.75 in. (70 mm). This results in an even heavier pole than that of FIGS. 6 and 7.

In contrast, an equivalent pole 900, shown in FIG. 9, made in accordance with the invention has the same external diameter as a conventional pole, such as those of FIGS. 5 to 7, and comprises a shell 902 and spaced apart clusters 903 of reinforcing wires 907 surrounded by spirals 905 and 909. Pole 900 would typically have an outer concrete cover of $\frac{3}{8}$ in. (10 mm), each cluster 903 containing five wires 907 of $\frac{1}{4}$ in. (6 mm) diameter in one circumferential ring and an inner cover of $\frac{1}{4}$ in. (6 mm) for a total wall thickness of $\frac{7}{8}$ in. (22 mm). Pole 900 of this construction would weigh 1300 lb. (590 kg.) or half that of a conventional reinforced concrete pole, which is a very desirable result.

Further description of the preferred embodiments is as follows:

(a) Hollow Cone of Wires

The hollow cone formed from a plurality of small diameter wires provides the primary structure of the pole and supplies most of the bending strength of the pole.

Wires having a diameter of about 0.04 to about 0.47 in. (1 to 12 mm), preferably 0.20 to 0.40 in. (5 to 10 mm), disposed circumferentially about, and extending in the direction of the longitudinal axis, and which have a yield strength above $8\times10^4$ psi and a modulus of elasticity above about $14.5\times10^6$ psi are found to meet the strength and deflection requirements of the pole.

The wires are disposed in a circumferential layer having a thickness of not more than 0.47 in. (12 mm). In this way the wires can be embedded in the polymer-containing matrix to produce a relatively thin, lightweight pole wall.

Metal wires are particularly suitable, especially steel wires. Cold drawn steel wires with a yield strength over $8\times10^4$ psi and a modulus of elasticity in excess of $14.5\times10^6$ psi are preferable, with wires having a yield strength over $16\times10^4$ psi and a modulus of elasticity of $29\times10^6$ psi being especially suitable.

The plurality of wires is suitably spaced in a regular array. It is especially preferred to dispose the wires in a symmetrical array comprising the groups or bundles of wires 104, 206, 304 and 306, the bundles being circumferentially spaced apart, and the wires within the bundles being in side-by-side relationship.

It is not necessary that the clusters or groups of wires be identical, although it is preferred that the groups be arranged and spaced apart in the aforementioned regular array. In this way the pole has the same bending strength in all directions perpendicular to the longitudinal axis.

The clusters of wires may contain wires of varying lengths, at least some of which extend the full height of the cone. There may be more wires in the clusters at the base of the pole and less wires at the tip of the pole, so that this bending strength of the pole decreases along the pole axis towards the tip of the pole.

The use of small diameter wires in accordance with the invention contributes to the reduction in pole wall thickness.

The small diameter wires employed in the invention are distinguished from reinforcing bars or rods employed in conventional reinforced concrete poles, not only by their lower diameter but also by their greater yield strength and lack of deformations. In particular, the wires do not meet the requirements for reinforcing bars or rods set forth in A.C.I. 318-83 Building Code Requirements for Reinforced Concrete.

Furthermore, in an especially preferred embodiment the wires which extend the full length of the pole are prestressed, and are of steel having an ultimate strength of 250,000 to 270,000 psi.

A minimum diameter of reinforcement can be achieved, in part, by using a tapered pole, with its largest diameter at the butt and by using a multiplicity of axial wires of different length, such that all the wires are present at the butt end, where the circumference is large enough to contain them, while only the longest wires reach the tip where the circumference is small. This physically possible distribution of wires provides the maximum area of axial reinforcement at the butt end, where it is needed, and a lesser area at the tip, where less reinforcement is required.

A further reduction in the diameter of the reinforcement is achieved since the strength of the axial reinforcement can be increased above the maximum found acceptable for reinforcing conventional concrete structures.

(b) Matrix

The wires are encapsulated in the matrix which is a polymer-containing matrix which is an impermeable polymer concrete or polymer impregnated concrete.

A polymer concrete is formed from a mixture of a polymer and mineral aggregate; a polymer impregnated concrete is a concrete formed by drying a Portland Cement concrete and impregnating with a polymer to fill the pores and voids and render it substantially impermeable to corrosive aqueous liquids. The impregnation is achieved with monomers which form the polymer, whereafter the monomers are cured or polymerized.

A polymer concrete comprises about 7 to 20%, typically about 10 to 15%, by volume of the polymer; whereas a polymer impregnated concrete comprises about 3 to about 5%, generally about 4%, by volume of polymer.

The mineral aggregate in both polymer concrete and polymer impregnated concrete may comprise coarse and fine aggregate as well as fines.

The selection of a suitable polymer is within the skill of persons in the art having regard to the particular characteristics required.

In particular, the polymer should be rubbery at ambient temperatures to provide high ductility as compared with glassy polymers which provide strength but are brittle. A particular advantage of ductile, rubbery polymer is that crack formation is reduced as compared with brittle glassy polymer, and any cracks produced in the pole wall will be short, essentially non-penetrating cracks. Thus access of aqueous corrosive liquids to the wire reinforcement through cracks formed in the pole wall is reduced.

The polymer-containing matrix of the invention will typically have a density of the order of 160 lbs/ft$^3$ as compared with 155 lbs/ft$^3$ for Portland Cement concrete of conventional reinforced concrete poles, and 30 lbs/ft$^3$ for wood poles.

In the case of the polymer concrete, the polymer should form a satisfactory bond with the wires and the polymer concrete must, of course, have sufficient strength when molded about the hollow cone to support the wires of the cone in their cone-forming shape and to force the wires to perform structurally as a group.

In order to provide durability the polymer both for the polymer concrete and the polymer impregnated concrete should be chemically inert both to the wires and aqueous corrosive liquids encountered by the pole in use.

Although the hollow cone of wires provides the primary strength and deflection characteristics of the pole, the matrix should be stiff enough to provide a stiffening effect, at least until the load reaches 25% of the breaking strength of the pole, in order to decrease the deflection and stress fluctuations under all except high loading, which is rarely experienced.

It is found that an appropriate stiffening effect is provided by a matrix having a compressive strength in excess of 5,700 lbs/in. of perimeter or circumference ( 1 MN per meter), and a modulus of elasticity in excess of $2.85\times10^6$ lbs/in. of pole perimeter (500 MN per meter).

It will be understood that the reference to "circumference" is not intended to restrict the invention to poles of circular cross-section, and poles of non-circular cross-section, for example, poles having a polygonal peripheral surface, such as poles 200 and 300, are also contemplated by the invention. As employed herein the term "circumference" is to be understood as extending to the imaginary circumference or the circumference of an imaginary circle extending about the peripheral surface of a pole of non-circular cross-section.

The matrix should have a density such that the cone wall formed by the matrix and the embedded hollow cone of wires has a weight of no more than 20.5 lb/ft (100 kg/m$^2$) of cone wall for poles having a length of up to 66 ft. (20 m.) and a proportionally larger weight for larger poles.

The matrix should form a relatively smooth molded or cast surface having a hardness comparable to that of steel, stone or glass; and should preferably form a molded or cast surface of substantially uniform colour, particularly a whitish grey colour.

The solid tubular wall should be relatively resistant to staining.

The polymer is most suitably a thermosetting resin, and acrylate polymers and copolymers, especially the methacrylates, for example, polymethyl-methacrylate, have been found to provide particularly good results both in polymer concretes and polymer impregnated concretes.

Polymer concretes are suitably made by mixing the mineral aggregate and the unpolymerized polymer ingredients and effecting partial polymerization or curing, by heat or catalysts, during the mixing to form a moldable or plastic mixture and solidifying the mixture by completing the polymerization or curing after molding.

Thus the moldable mixture is molded about the hollow cone of wires, whereafter the polymerization or curing is completed. The preferred method of molding is centrifugal casting, but injection molding and extrusion processes could be used as well.

Polymer impregnated concretes are suitably made by forming and shaping, for example, by centrifugal casting, Portland Cement concrete to the desired shape, curing the concrete, drying the shaped concrete to remove water from the pores and voids, impregnating the porous concrete with the polymer-forming monomers and any polymerization additives such as curing agents or catalysts to fill the pores, and polymerizing or curing, for example, by heating.

Thus the Portland Cement concrete is shaped about the hollow cone and allowed to cure, whereafter it is dried and impregnated and the polymerization is effected.

(c) Pole

The pole which includes the hollow cone of wires encapsulated in its matrix, is typically formed as an elongate member with a slight taper from base to tip. In one embodiment the pole 100 (FIG. 2) is of generally circular cross-section and has the form of an elongate, truncated cone. Other cross-sections, for example, polygonal cross-sections such as poles 200 (FIG. 3) and 300 (FIG. 4) are also possible.

Poles which have a plurality of flat side walls provide some advantages in that the location of wire free zones can be more readily located for mounting attachments and hardware, otherwise plugs 126 are used as shown in FIG. 2.

In general, the taper of the pole is about 1.5% with the base having a diameter of about 2.5% of the length and the tip a diameter of 1 to 1.25% of the length.

In providing an acceptable pole for urban use it is important that the poles remain substantially straight under everyday loadings.

The poles of the invention suitably have a deflection of not more than about 3% of the height under a load of 25% of the ultimate strength, and thus are substantially straight most of the time.

Suitably the poles exhibit a permanent set of not more than 0.5% of the length after application of a load of 60% of the ultimate strength.

(d) Spiral Reinforcing Elements

In an especially preferred embodiment the circumferentially extending reinforcing elements are spirally wound about the outer and inner faces of the hollow cone of wires. In addition to increasing the shear strength of the matrix, especially at the tip of the pole, the reinforcing elements particularly those wound on the inner face of the hollow cone, assist in holding the axial wires of the hollow cone in place during formation of the pole.

The spiral reinforcing elements may be selected to provide either strength or durability.

The spiral reinforcing elements may, in particular, be structural steel wires, stainless steel wires or inert, plastic, wire-like extruded members, for example, fibres of Kevlar. Steel reinforcing elements are particularly strong and for the purposes of this disclosure are referred to as strong reinforcing elements. Kevlar reinforcing elements are particularly inert and durable, for the purposes of this disclosure are referred to as inert, durable reinforcing elements.

For the upper part of the pole, the spiral reinforcing elements may conveniently comprise wires of the same type of material as employed for the hollow wire cone, since the requirement for strength is greater and the exposure to corrosive elements is less than at the butt or base of the pole.

Reinforcing elements to provide strength are less important at the bottom of the pole where the cross-section is larger. On the other hand, the effect of salt splash and freeze/thaw cycles in Northern climates; the effect of salt spray driven by hurrican force winds in subtropical climates; and the effect of insects, bacteria and ground born chemicals at and below grade levels may all dictate that the base end desirably be of great durability. The use of the spiral reinforcing elements at the base end of the pole also prevents or hinders splitting of the matrix along the axis of the hollow cone. For this purpose the coils of the spiral are desirably closely spaced to control crack size and formation and the elements are selected for durability rather than strength at the base of the pole.

Suitably inert, plastic fibres, for example, of Kevlar, rather than steel wires are particularly good at the base of the pole.

Accordingly, in some applications, it is desirable to have steel spiral reinforcing elements at the top end of the pole for strength and inert plastic reinforcing elements at the base of the pole for durability.

Finally, in some climates, such as desert climates, where corrosion of the cone of wires is not much of a problem, a more permeable matrix may be used. Similarly in extremely corrosive environments, precoating the wires of the cone of wires may also be employed to provide greater protection. A suitable pre-coating material as would be apparent to those skilled in the art would be used which would work with the matrix to provide even greater protection than either the coating or the matrix would provide alone. Alternatively, the matrix could be thicker at the base of the pole than at the top to provide more protection, in which case the cover would still taper uniformly to the top.

I claim:

1. A pole to be used outdoors, exposed to the corrosive elements of the weather, for public utility lines, lighting apparatus and the like, comprising: an elongate, tubular pole wall comprising a plurality of elongate wires having diameters of about 0.04 to about 0.47 in., the wires being disposed in a circumferential layer about 0.04 in. to about 0.47 in. in thickness and arranged to give equal bending strength in any direction perpendicular to the longitudinal axis of the pole, at least some of said wires extending substantially the full axial length of said pole, said wires having a yield strength above 80,000 psi and a modulus of elasticity in excess of $14.5\times10^6$ psi, a polymer-containing matrix bonded to the wires to form a shell encapsulating the wires, said shell having a regular outer surface, the matrix being formed of a mass comprising particulate mineral aggregate with free spaces within said mass filled with said polymer, such that said matrix is substantially impervious to aqueous corrosive liquid, said pole wall having a weight less than 20.5 lb/ft$^2$, for a pole having a length up to 66 ft. and a proportionally greater weight per unit area for poles having a length greater than 66 ft.

2. A pole according to claim 1, wherein said wires are cold drawn steel wires having a diameter of 0.2 to 0.4 in., an yield strength above 160,000 psi and a modulus of elasticity of $29\times10^6$ psi.

3. A pole according to claim 2, wherein the polymer of said matrix is rubbery at ambient temperatures.

4. A pole according to claim 2, wherein a subplurality of said plurality of wires extends substantially the full length of the pole, the wires of said sub-plurality being prestressed.

5. A pole according to claim 3, wherein said matrix is a polymer concrete.

6. A pole according to claim 3, wherein said matrix is a polymer impregnated concrete.

7. A pole to be used outdoors, exposed to the corrosive elements of the weather, for public utility lines, lighting apparatus and the like, comprising: a pole wall including; an elongate, tubular pole wall comprising a plurality of elongate steel wires having diameters of about 0.2 in. to about 0.4 in., the wires being disposed circumferentially in a unitary layer, said wires extending in the direction of the longitudinal axis of the pole and arranged to give equal bending strength in any direction perpendicular to the longitudinal axis of the cone, at least some of said wires extending substantially the full axial length of said pole, said wires having a yield strength above 80,000 psi and a modulus of elasticity in excess of $14.5\times10^6$ psi, a polymer containing matrix bonded to the wires to form a thin shell encapsulating the wires, said shell having an inner surface and an outer surface, said outer surface being symmetrical about each corner or diameter, the wires in said circumferential layer being grouped in circumferentially spaced apart clusters within said shell, each cluster comprising a plurality of wires in side-by-side relationship, and said spaced apart clusters forming a symmetrical array about the longitudinal axis, said circumferential layer of clusters being disposed intermediate said inner and outer surfaces, said clusters being located in zones spaced closer to said inner surface than said outer surface, the matrix being substantially free of water and formed of a mass comprising particulate mineral aggregate with free spaces within said mass filled with the polymer, such that said matrix is substantially impervious to aqueous corrosive liquid, said matrix not having the capability of neutralizing aqueous corrosive liquid to protect said steel wires from aqueous corrosive liquid but having the capacity to protect said steel wires from corrosion by aqueous corrosive liquid when its thickness over the wires is about 0.4 in., said polymer being rubbery at ambient temperatures, and the pole wall having a weight less than 20.5 lb/ft$^2$ of the wall for a pole having a length up to 66 ft. and a proportionally greater weight per unit area for poles having a length greater than 66 ft. similar to the weight of a wood pole of comparable external dimensions and significantly less than the weight of a hollow concrete pole reinforced with steel rods, of comparable external dimensions.

8. A pole according to claim 7, wherein a sub-plurality of said plurality of wires extends substantially the full length of the pole, the wires of said sub-plurality being prestressed, the remaining wires not being prestressed.

9. A pole according to claim 8, further including elongate reinforcing elements wound spirally on said steel wires, said elements comprising steel wires in a region adjacent an upper end of the pole, and durable plastic elements in a region adjacent a lower end of the pole, said plastic elements in said region adjacent the lower end being closely spaced to control crack size and formation and being effective to prevent or hinder splitting of the matrix along the axis of the pole.

10. A method of producing a pole as defined in claim 1, which comprises:

forming a hollow cone of said wires, binding the wires with spiral reinforcement to hold same in place, molding a moldable polymer concrete about said cone to form an encapsulating shell with said hollow cone embedded therein, and solidifying the cone wall.

11. A method of producing a pole as defined in claim 1, which comprises:

forming a hollow cone of said wires, binding the wires with spiral reinforcement to hold same in place, casting a Portland Cement concrete about said cone to form a shaped encapsulating shell, solidifying the shaped encapsulating shell, drying the shaped shell to remove water from pores and voids, impregnating said shell with polymer-forming monomers to fill the pores and voids, and polymerizing or curing the monomers to a polymer.

* * * * *